US011480401B1

(12) United States Patent
Burd

(10) Patent No.: US 11,480,401 B1
(45) Date of Patent: Oct. 25, 2022

(54) INTEGRATED MAGAZINE LOADING ASSIST DEVICE

(71) Applicant: Glenn W Burd, Saxonburg, PA (US)

(72) Inventor: Glenn W Burd, Saxonburg, PA (US)

( * ) Notice: Subject to any disclaimer, the term of this patent is extended or adjusted under 35 U.S.C. 154(b) by 0 days.

(21) Appl. No.: 17/657,751

(22) Filed: Apr. 2, 2022

Related U.S. Application Data

(60) Provisional application No. 63/186,377, filed on May 10, 2021.

(51) Int. Cl.
*F41A 9/83* (2006.01)

(52) U.S. Cl.
CPC ..... *F41A 9/83* (2013.01)

(58) Field of Classification Search
CPC ..... F41A 9/83; F41A 9/84
See application file for complete search history.

(56) References Cited

U.S. PATENT DOCUMENTS 4,827,651 A * 5/1989 Conkey ..... F41A 9/83 42/87
6,286,243 B1 * 9/2001 Hinton ..... F41A 9/83 42/87
2016/0025437 A1 * 1/2016 Slocum ..... F41A 9/83 42/87

* cited by examiner

*Primary Examiner* — J. Woodrow Eldred
(74) *Attorney, Agent, or Firm* — Karen Tang-Wai Sutton

(57) ABSTRACT

An integrated magazine loading assist device in two embodiments, each embodiment having a body with an inner facing side and an outer facing side, an outer wall having four sizes formed on the outer facing side, a perimeter wall formed on three of the four sizes of the outer wall, an a tab having a wall end attached to the perimeter wall and an unattached opposed end extending from the perimeter wall over the outer wall, with a magazine-receiving gap formed between the tab and the outer wall. The inner facing side is either removably or fixedly attached to a detachable magazine or attached to a rail of a gun. The opposed end of the tab is shaped to mate directly with an exterior shape of an ammunition round or shaped to mate with a piece that mates with the ammunition round.

9 Claims, 11 Drawing Sheets

INTEGRATED MAGAZINE LOADING ASSIST DEVICE

CROSS-REFERENCE TO RELATED APPLICATIONS

This application claims benefit of U.S. provisional patent application Ser. No. 63/186,377 filed May 10, 2021 and under all applicable sections of Title 35 of the United States Code including, but not limited to, Sections 120, 121, and 365(c), and which in its entirety is incorporated by reference into this application.

STATEMENT REGARDING FEDERALLY SPONSORED RESEARCH OR DEVELOPMENT

NA

NAMES OF THE PARTIES TO A JOINT RESEARCH AGREEMENT

NA

INCORPORATION BY REFERENCE OF MATERIAL SUBMITTED ON A COMPACT DISC OR AS A TEXT FILE VIA THE EFS WEB SYSTEM

NA

STATEMENT REGARDING PRIOR DISCLOSURES BY THE INVENTOR OR A JOINT INVENTOR

NA

BACKGROUND OF THE INVENTION

Field of the Invention

The present invention pertains to the field of ammunition magazines for guns. Specifically, the invention is an ammunition loading assist device integrated into one of a base plate of a detachable magazine and a conveniently located removable loading assist device attached to a gun rail, and combinations thereof.

Background Art

Many guns use ammunition magazines. A magazine stores multiple ammunition rounds and automatically positions the next round into a firing chamber of the gun. Detachable magazines allow a user to carry multiple, preloaded magazines for fast reloading and firing. The magazine is comprised of a hollow metal body, typically with a top end shaped to complement a single round, a removable base plate at its bottom end, with a follower, and a wire spring pushing against the base plate and the follower inside the body between the top and bottom ends. The follower is an ammunition round receiving structure sized and shaped to complement a shape of the ammunition round or cartridge. The wire spring, sandwiched between an underside of the follower and the base plate, exerts force against both structures even when the magazine is empty, resulting in the follower being positioned at the top end of the body, ready to receive the round to be loaded. When the magazine is fully loaded with ammunition, the wire spring is completely compressed within the body. The magazine is then positioned inside the pistol or rifle. When the gun is fired, each round is sequentially and automatically fed into a firing chamber of the gun from the magazine via the follower and the wire spring. As the wire spring must quickly and automatically position each round into the firing chamber, the spring force is relatively strong to ensure that all rounds are fed into the firing chamber with a same force and speed each time.

A known issue with magazines is that the relative strength of the internal wire spring is strong and thus difficult to compress while manually loading rounds into the magazine. A first round is easily inserted into the follower, but each subsequent round becomes relatively increasingly difficult to insert due to the compression force of the spring pushing up against the follower and the slippery, smooth contoured external surfaces of the rounds eliminating frictional forces that might otherwise be used to help ease the next round into the magazine. While possible to load a detachable magazine by hand, it is difficult and time consuming, so gun manufacturers have developed magazine loading assist devices to speed up and simplify this process. There are many multi-brand magazine loading devices on the market, as well as ones made specifically for certain gun models and manufacturers.

Current magazine loading assist devices are essentially hollow housings sized and shaped to fit over the top end of the magazine, with an integral downwards-facing tab sized and shaped to depress a primer end of the round (the end opposite the bullet end) so as to create space for the next round to be inserted into the magazine. While greatly increasing the speed at which magazines can be manually loaded, the assist device itself is a bulky hollow tube that must then be carried along with any extra magazines and ammunition. This is not an issue for the user heading to the gun range with a range bag that can store extra items, but for situations where toting a range bag is inconvenient, this extra bulky piece of equipment essentially must be shoved into a pocket and take up valuable space that otherwise would be used for an additional loaded magazine.

What is needed is a magazine assist loading device that is integrated directly into the magazine itself so that it takes up no extra space, cannot be lost, and is always handy for the user to load the magazine while out in the field.

DISCLOSURE OF INVENTION

A magazine loading assist device for a detachable gun magazine having a body with an inner facing side and an outer facing side, a four sided outer wall positioned on the outer facing side with a perimeter wall formed along three of the four sides of the outer wall. An integral tab extending away from the perimeter wall has a wall end attached to the perimeter wall and an unattached opposed end, with a gap formed between the tab and the outer wall, the gap sized and shaped to receive a notched uppermost end of the detachable magazine.

The magazine loading assist device in a first embodiment is a detachable base plate of the magazine and in one embodiment of the base plate the body is configured as a finger extension base plate, with the perimeter wall being tapered along two of the three sides.

The magazine loading assist device in a second embodiment is removably or permanently attached to a gun rail with the inner facing side of the device mounted to the rail. When the second embodiment is removably attached to the gun rail, the device is adjustably sized to the rail by an adjustment knob.

The opposed end of the tab of the first or second embodiment of the magazine loading assist device is at least one of approximately curved and sized and shaped to mate with an external shape of an ammunition round, comprised of at least one of a compressible and adhesive material, and shaped to removably mate with a mating piece sized and shaped to receive a specific ammunition round caliber size.

BRIEF DESCRIPTION OF THE DRAWINGS

The features and advantages of the invention will become apparent from a consideration of the subsequent detailed description presented in connection with accompanying drawings, in which.

DRAWINGS LIST OF REFERENCE NUMERALS

Figure 1:
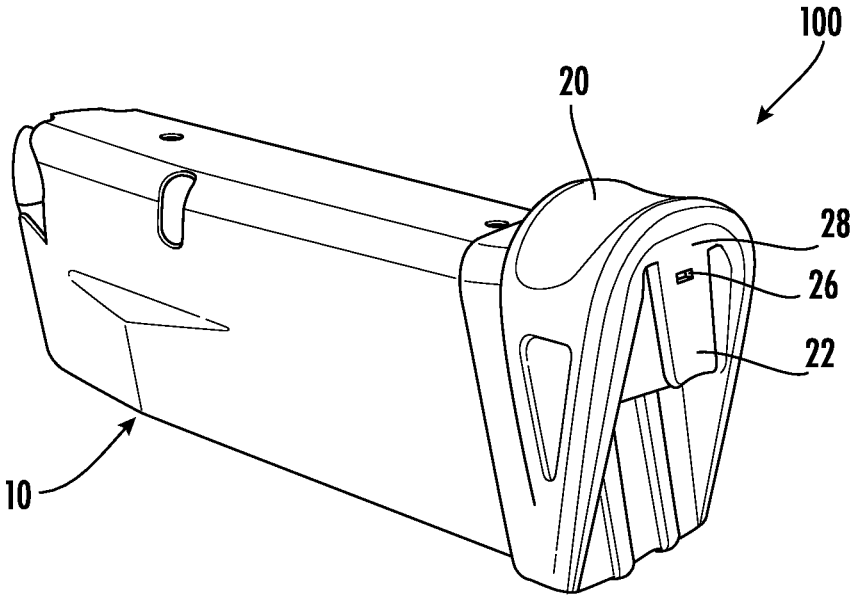
FIG. 1 is a perspective view of an integrated magazine loading assist device according to the invention, shown installed on a magazine.

The following is a list of reference labels used in the drawings to label components of different embodiments of the invention, and the names of the indicated components.

100 integrated magazine loading assist device or device
10 detachable magazine or magazine
12*a* notched uppermost portion of top end of magazine
20 body or base plate or finger extension base plate
20*a* spring or inner facing side
20*b* outer wall
20*c* outer facing side
20*p* prior art finger extension base plate
22 tab
24 gap
26 adjustment hole
28 perimeter wall
30 prior art magazine loading assist device
32 pistol or gun
40 ammunition round or round
42 primer end
44 bullet end
50 rail
52 rail mount
54 adjustment knob

DETAILED DESCRIPTION

Figure 7:
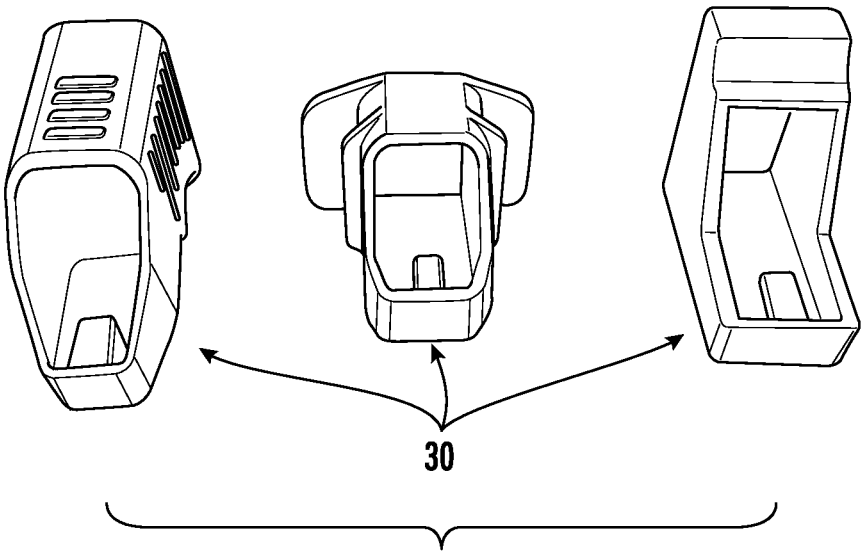
PRIOR ART FIG. 7
FIG. 7 is a perspective view of a plurality of prior art magazine loading assist devices.
Figure 8:
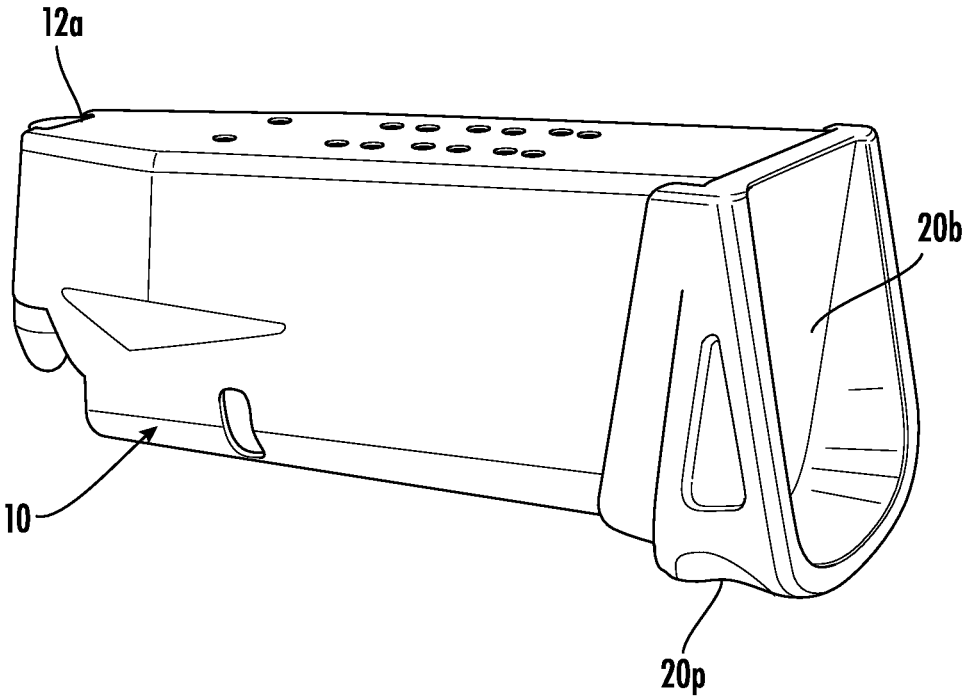
PRIOR ART FIG. 8
FIG. 8 is a perspective view of a prior art magazine installed with a finger extension base plate.
Figure 9:
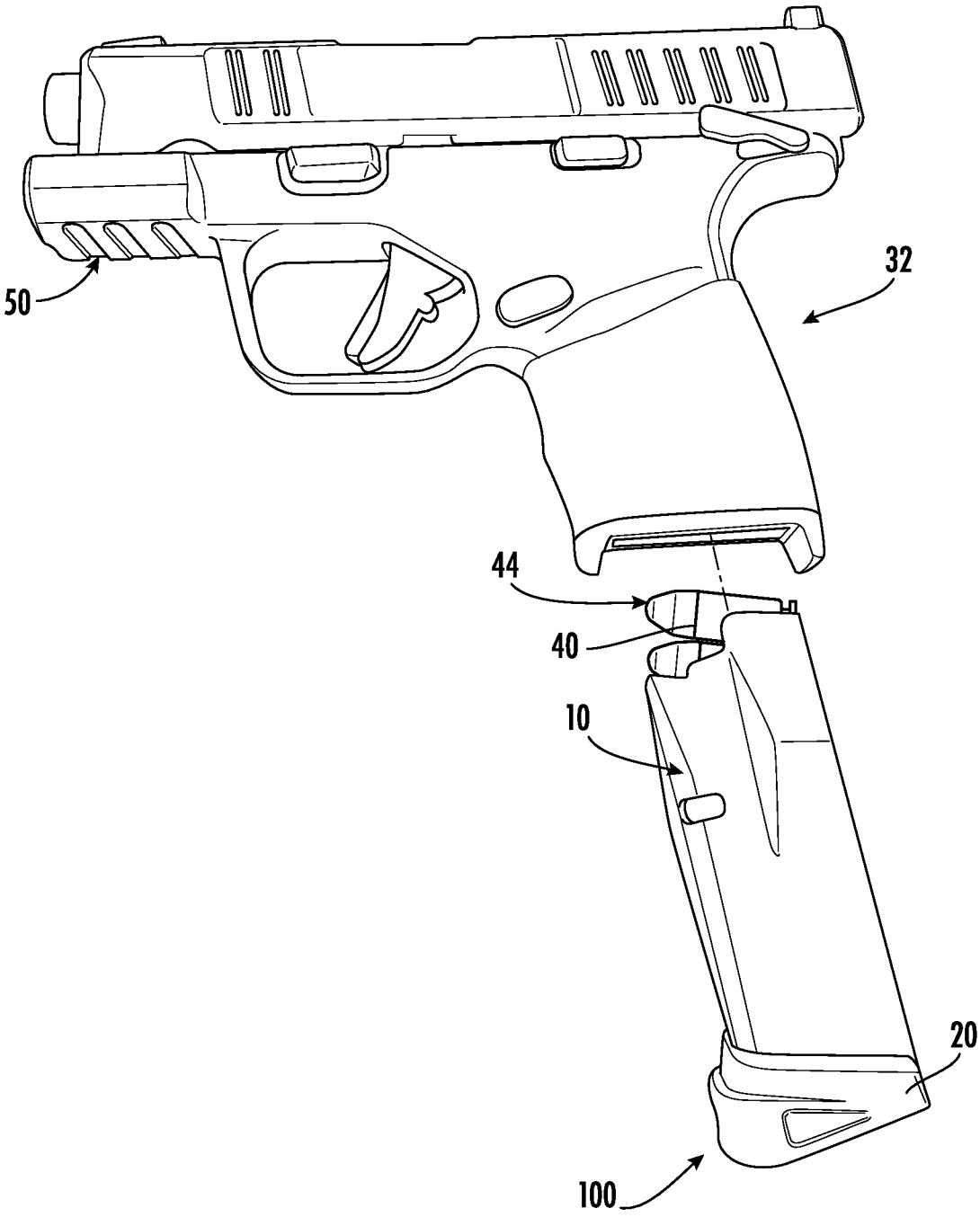
FIG. 9 is a side elevation view of a pistol and with a detachable magazine fitted with the integrated magazine loading assist device according to the invention.
Figure 18:
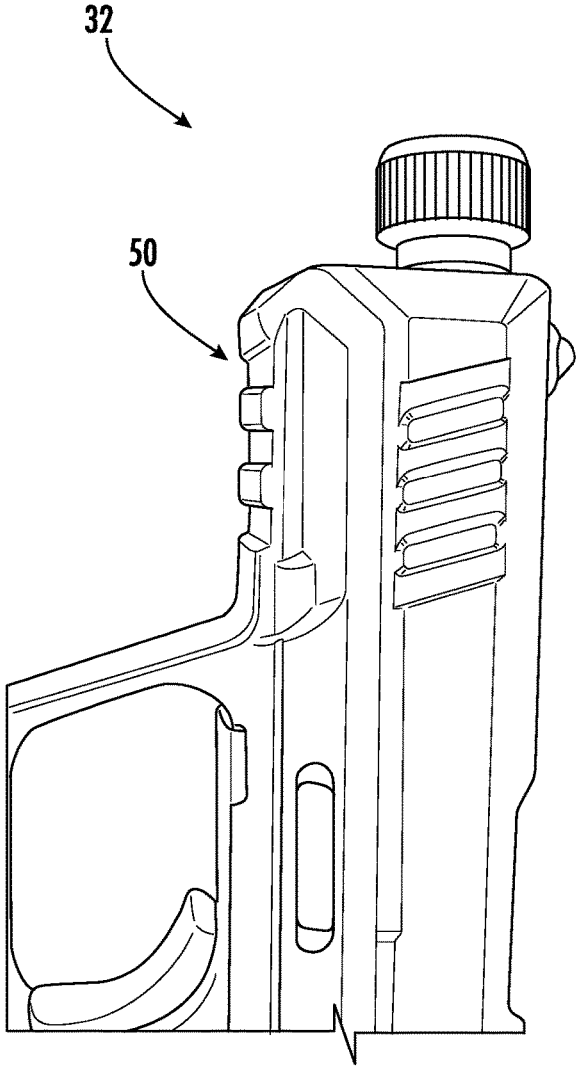
PRIOR ART FIG. 18
FIGS. 18 and 19 are perspective and front views of the prior art rail on the prior art pistol in FIG. 9.
Figure 19:
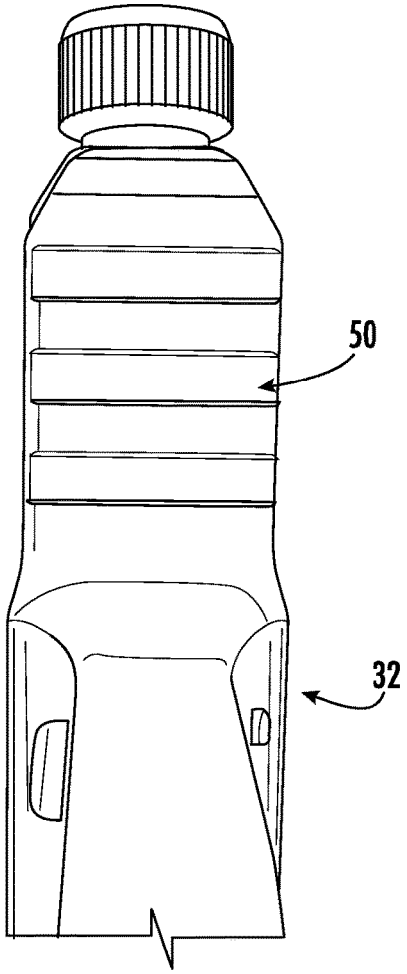
PRIOR ART FIG. 19
Figure 20:
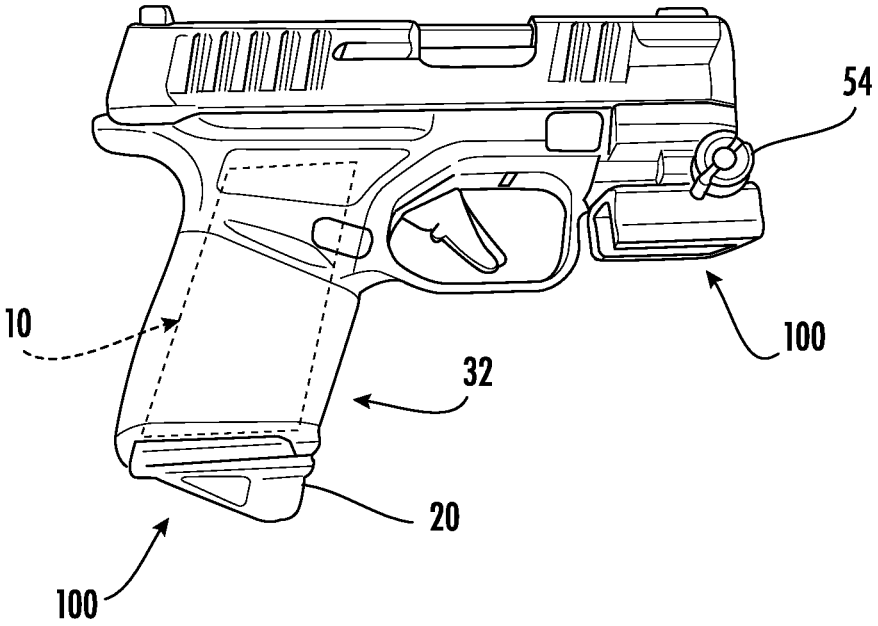
FIG. 20 is a side elevation view of the pistol in FIG. 9 shown with the integrated magazine loading assist device installed on the rail.
Figure 21:
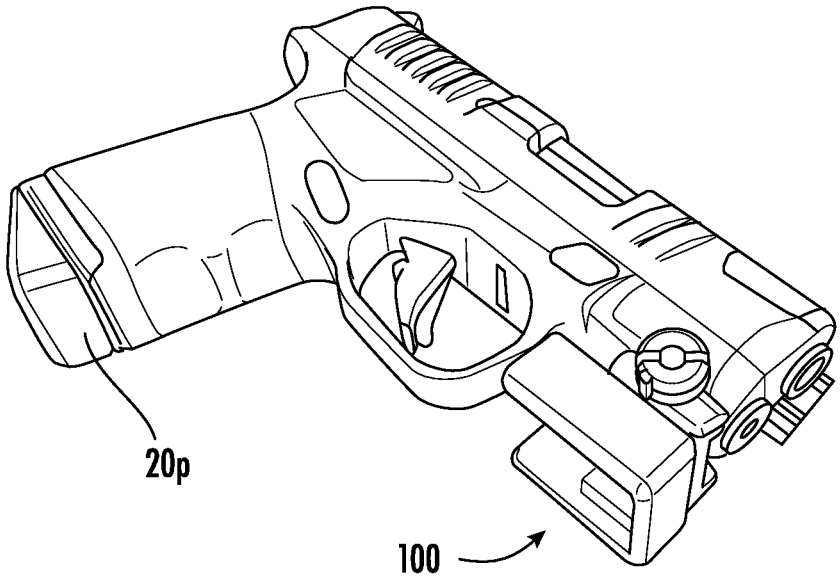
FIG. 21 is a perspective view of a pistol and installed integrated magazine loading assist device, shown with the prior art finger extension plate.

An integrated magazine loading assist device or device according to the invention 100 is shown in FIGS. 1-6 and 9-21, with prior art magazine loading assist devices and base plates shown in FIGS. 7-8, and prior art rails shown in FIGS. 9, 18-19.

Turning to the Figures, in a first embodiment, the device 100 is comprised of a body configured as a base plate of a detachable magazine 10, and as shown in the Figures, configured as a finger extension base plate or base plate 20 having a spring or inner facing side 20*a* and an opposed outer facing side 20*c*. The base plate, in a side elevation view as in FIG. 2, approximates a right triangle, with an opposite side being a finger rest area, shown in FIG. 2 as an area with a slight concave profile, designed to allow a gun user to comfortably position a pinkie finger (not shown) in the finger rest area. A hypotenuse side of the right triangle has a magazine receiving lip (not shown) and an inner wall (shown in FIG. 3) all on the inner facing side 20*a* of the base plate 20. On the outer facing side 20*c* is an outer wall 20*b* having four sides approximating a rectangle, with the outer wall 20*b* approximately parallel with the hypotenuse side. The finger rest area of the base plate 20 is on an opposite side of the triangle. A perimeter wall 28 formed along an adjacent sided of the triangle along three sides of the outer wall 20*b* also approximates a second right triangle in a side elevation view, when viewed with the outer wall 20*b* as an adjacent side of the second right triangle, and where the perimeter wall 28 below the finger rest area is a second opposite side, with the perimeter wall 28 on either side of the finger rest area tapering towards a fourth side of the outer wall 20*b* serving as the adjacent sides of the second right triangle. The outer facing side 20*c* comprising the perimeter wall 28 and outer wall 20*b* thus is shaped akin to a scoop having a base and three side walls and an open side without a wall. A tab 22 is formed at a midpoint of the perimeter wall 28 directly below the finger rest area. The tab 22 projects away from the perimeter wall 28 and in spaced apart relationship and parallel to the outer wall 20*b*. The tab 22 does not project above the perimeter wall 28, so that it is not visible in a side view as in FIG. 2, resulting in a flat surface on the outer facing side 20*c* to allow the magazine 10 fitted with the base plate 20 to be supported by the base plate 20 when positioned on a table or other flat surface. A space or gap 24 between the tab 22 and the outer wall 20*b* is sized and shaped to fit into a notched uppermost portion 12*a* of a top end of the detachable magazine 10 immediately adjacent a primer end 42 of an ammunition round or round 40 loaded into a follower of the magazine 10, as shown in FIGS. 8 and 11.

The tab 22 features a sloped free end shaped with a curve complementing an exterior surface of the round 40 loaded into the magazine 10 and thus maximize physical contact between the tab 22 and the round 40. The device 100 is installed on a lowermost end of the magazine 10, replacing a prior art base plate 20*p* shown in FIG. 8, or a prior art flat base plate (not shown) that does not have a finger extension or rest area. An adjustment hole 26 is formed as a through hole into the tab 22 and through the outer wall 20*b* into the inner facing side 20*a*, and is sized and shaped to receive a tip of a standard paper clip when a portion thereof is unbent, to allow the base plate 20 to be removed from the magazine 10, as is standard with the prior art base plate 20*p*.

Figure 2:
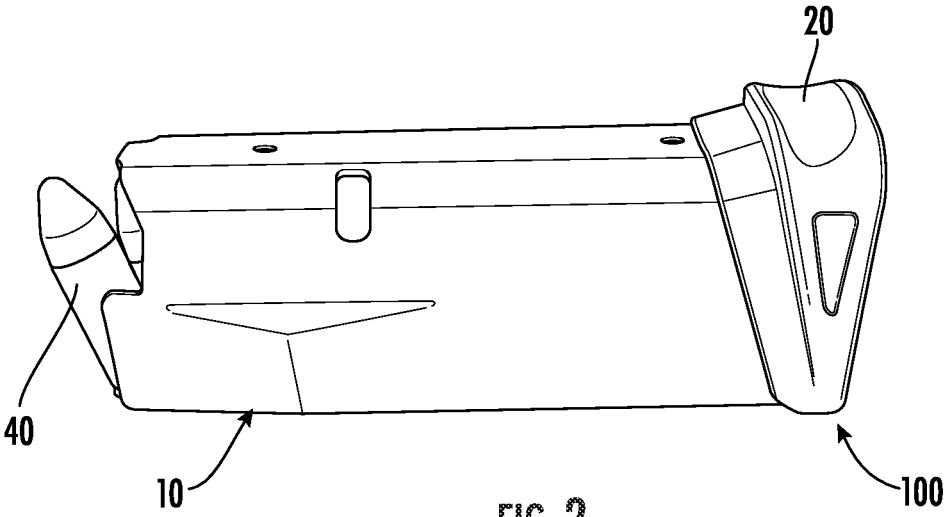
FIG. 2 is a side elevation view of the integrated magazine loading assist device in FIG. 1.
Figure 3:
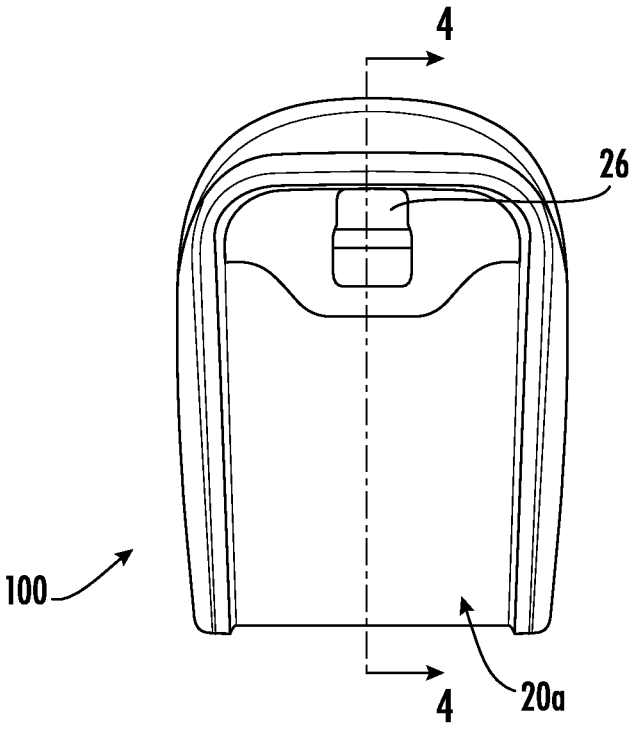
FIG. 3 is a top view of the integrated magazine loading assist device according to the invention, shown uninstalled on the magazine.
Figure 4:
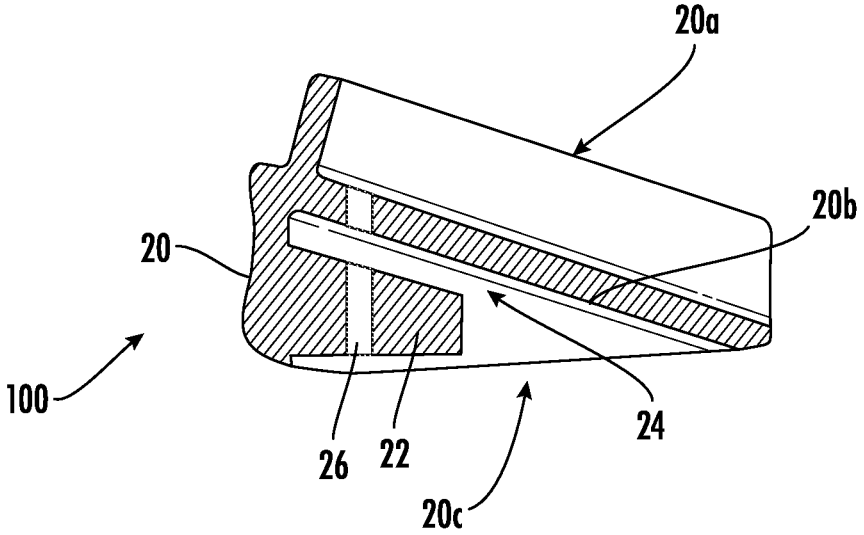
FIG. 4 is a side cross sectional view of the integrated magazine loading assist device in FIG. 3, taken along line 4-4 in FIG. 3.
Figure 5:
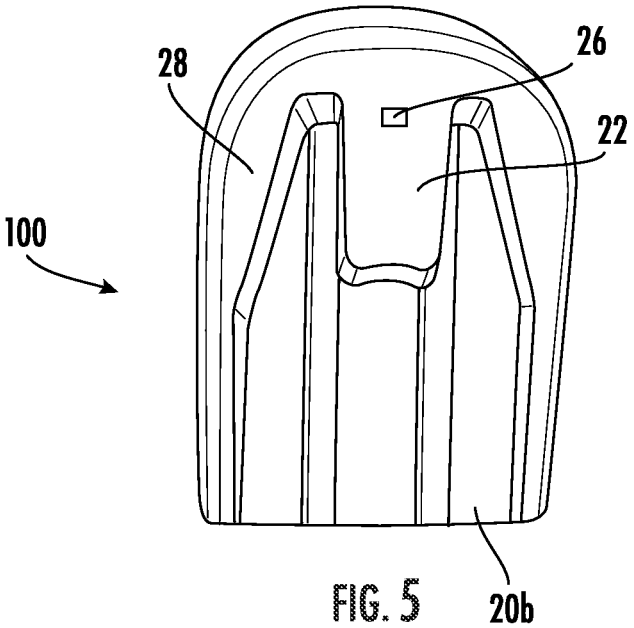
FIG. 5 is a second bottom view of the integrated magazine loading assist device in FIG. 3.
Figure 6:
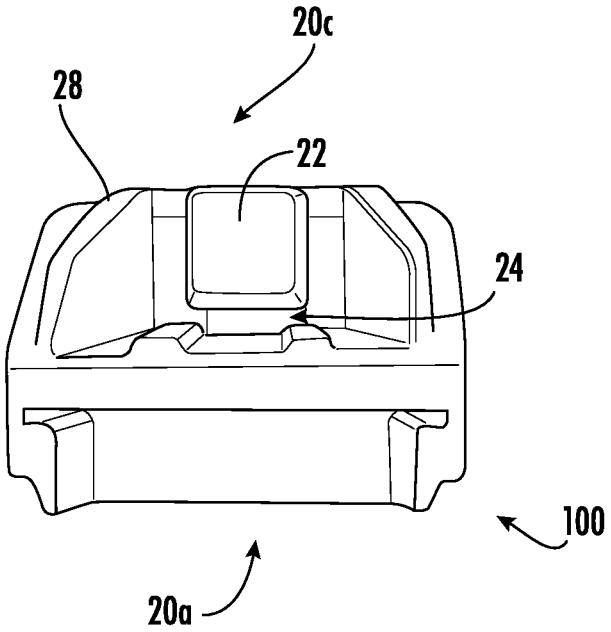
FIG. 6 is a front view of the integrated magazine loading assist device in FIG. 3.

When the device 100 is installed on the prior art magazine 10, a look, feel and function of the magazine is unchanged and as shown in FIG. 2, the tab 22 is not detectable from a side view, although the inventor notes that the perimeter wall 28 may be slightly taller than the prior art base 20*p* to accommodate the tab 22. Ideally, two or more detachable magazines 10 are each retrofitted with the device 100, allowing the user to simply hold one magazine fitted with the device 100 as a loading assist device as shown in FIGS. 10-11, in lieu of using the prior art loading assist devices 30 shown in FIG. 7.

Figure 10:
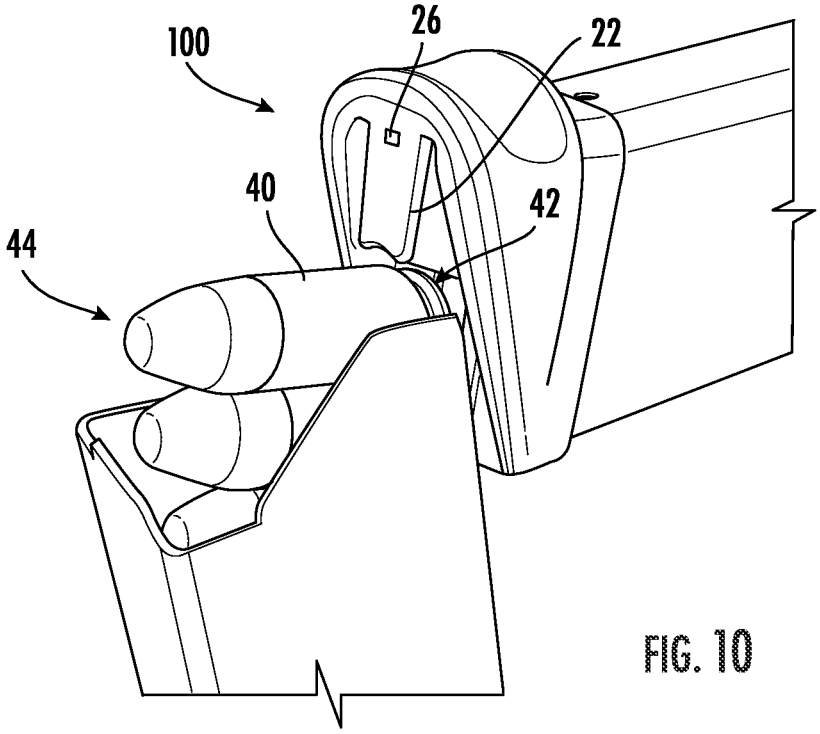
FIGS. 10 and 11 are perspective views showing method steps of how to use the integrated magazine loading assist device, with FIG. 10 showing a pre-loading or pre-depressed position of the assist device installed on a magazine and positioned over a magazine to be loaded with additional ammunition, with FIG. 11 showing the active loading or depressed position of the assist device pressing down on a primer end of the loaded round in the magazine to create space for a next round to be inserted therein.
Figure 11:
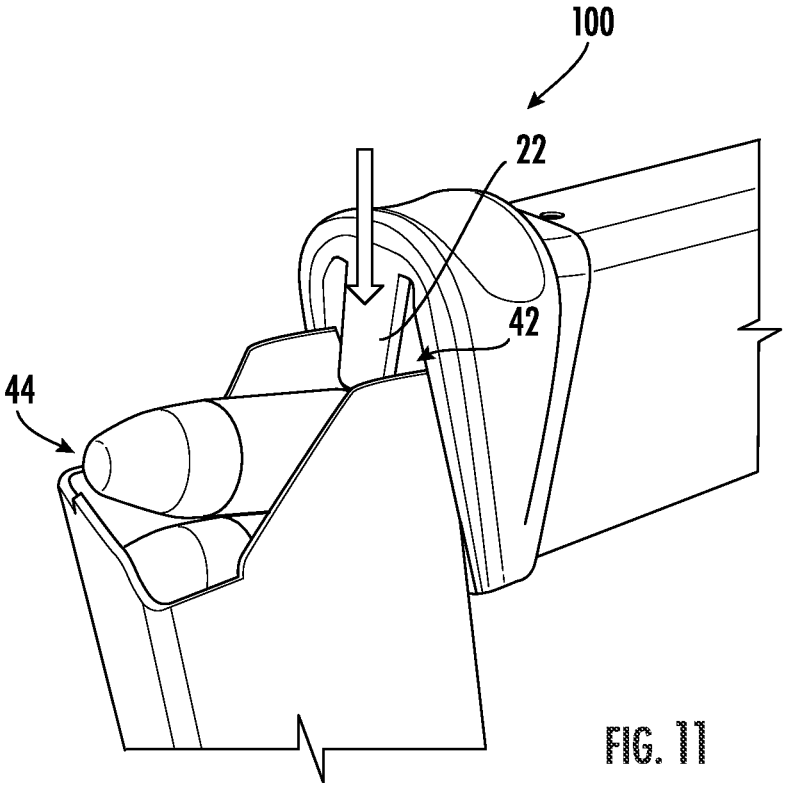
Figure 12:
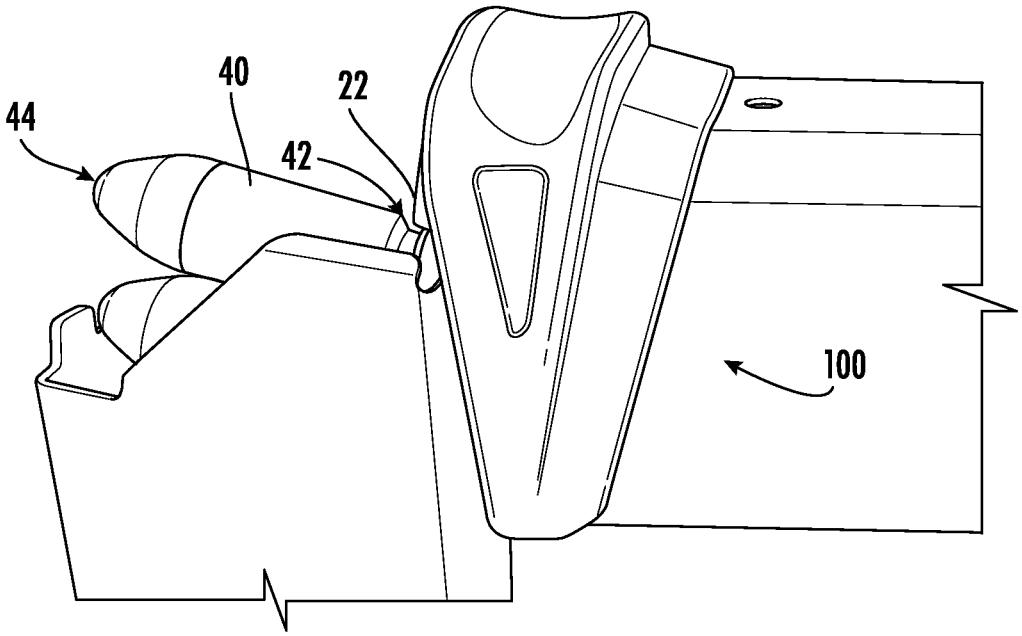
FIGS. 12 and 13 are side elevation views of FIGS. 10 and 11, respectively.
Figure 13:
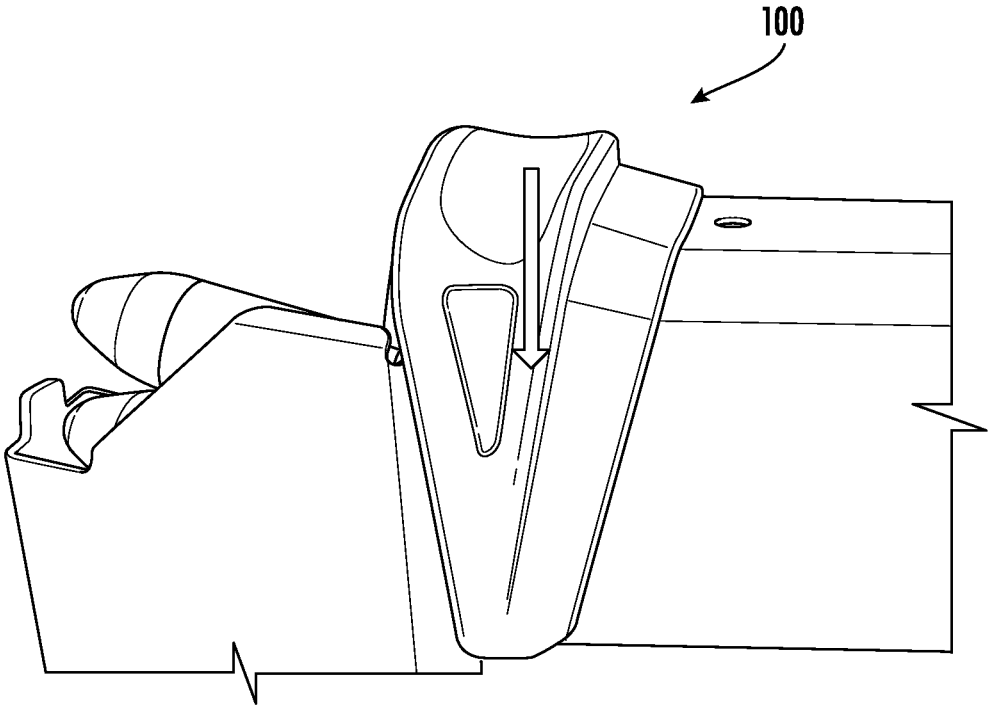
Figure 14:
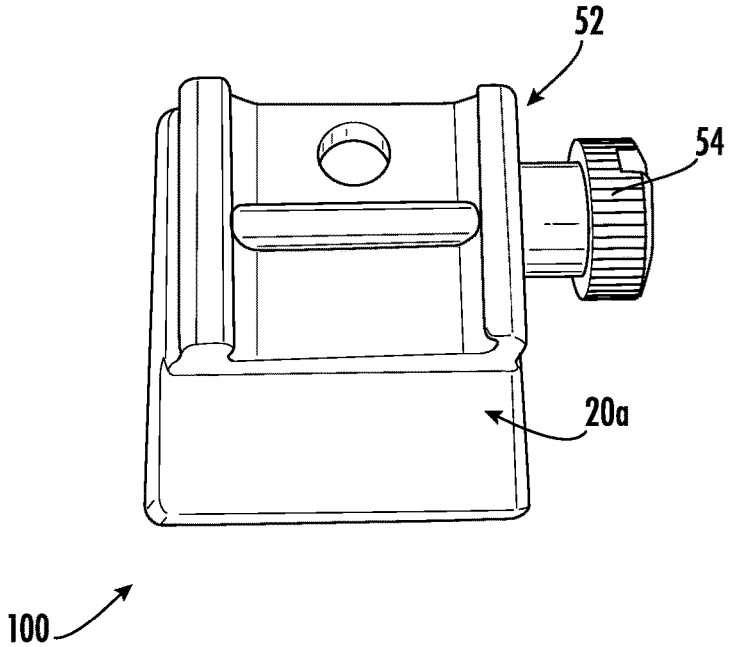
FIG. 14 is a top view of the integrated magazine loading assist device shown configured for a picatinny or weaver rail of a pistol.
Figure 15:
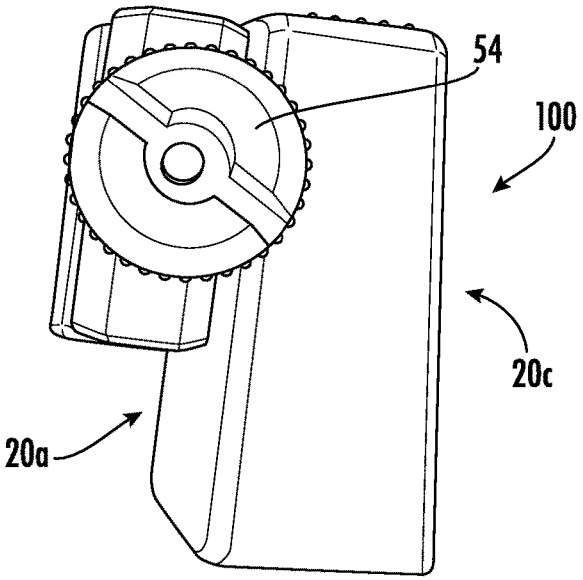
FIG. 15 is a first side view of the integrated magazine loading assist device in FIG. 14.
Figure 16:
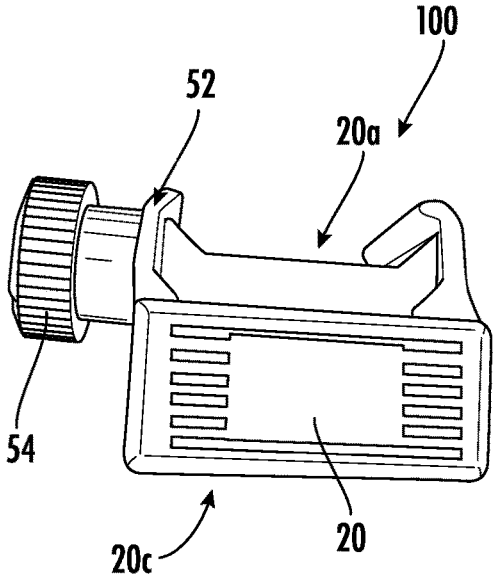
FIG. 16 is a back view of the integrated magazine loading assist device in FIG. 14.
Figure 17:
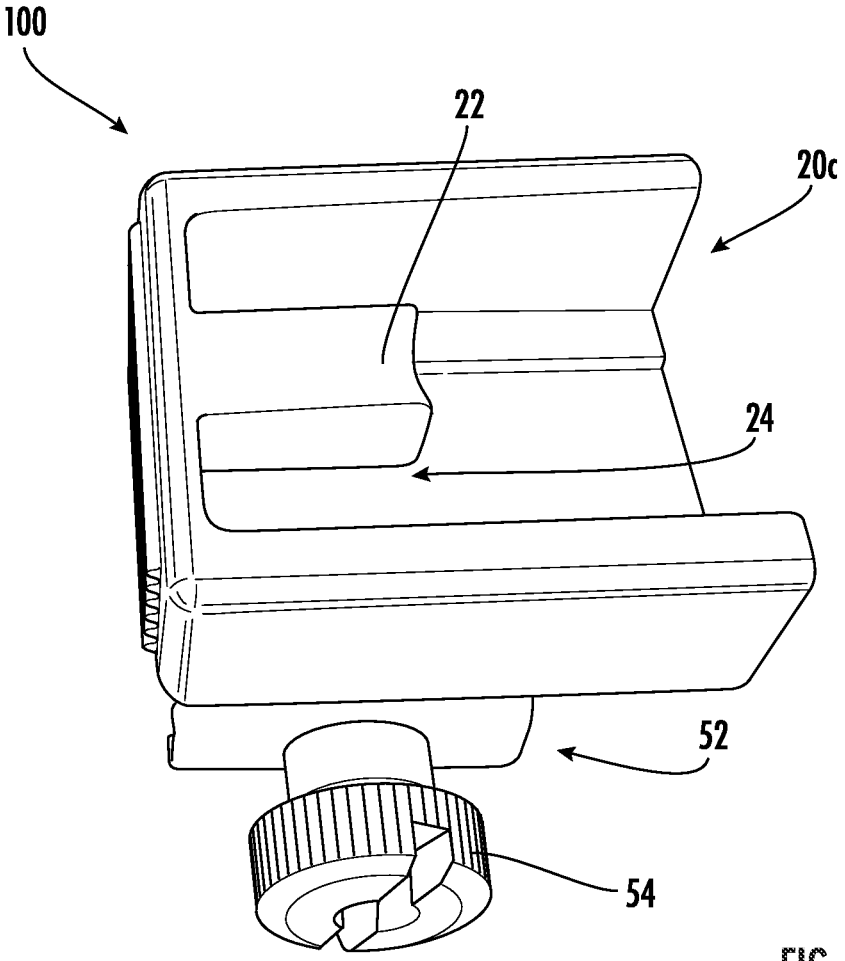
FIG. 17 is a perspective view of the integrated magazine loading assist device in FIG. 14.

To use the device 100, looking at FIGS. 10-11, the device 100, shown in the first embodiment installed on the magazine 10 as the base plate 20, is positioned above the magazine 10 to be loaded so that the gap 24 of the device 100 is directly above the notched uppermost end 12*a* of the magazine 10, positioning the tab 22 to be above the primer end 42 of an existing loaded round in the magazine 10. In FIG. 11, the tab 22 is pressed firmly downwards against the primer end 42 of the round 40 to compress the spring and cause the loaded rounds to move downwards into the magazine 10. As the device 100 is forced downwards on the primer end 42 of the round, the notched uppermost end 12*a* of the magazine 10 slides into the gap 24 between the outer wall 20*b* and the tab 22, creating a space within the magazine's inner chamber large enough to receive a next round 40 The user then slides the primer end 42 of the next round 40 into the space and pushes the bullet end 44 into position inside the magazine 10 and immediately adjacent the uppermost round 40. The inventor notes the device 100 can be held in one hand and the magazine to be loaded in the other hand, or the magazine to be loaded positioned against the user's chest or a flat surface such as a table while using the device 100 to load rounds 40. The device 100 shown in the Figures is a "universal" sized device, allowing use with a variety of detachable magazines. The inventor notes that the perimeter wall 28 can be easily configured to complement a size and shape of the top end of the magazine 10 and thus eliminate any side to side motion of the device 100 when in use. The prior art magazine loading assist devices 30, shown in FIG. 7, are typically sized and shaped to fit specific gun model magazines and to eliminate lateral motion with its complementary shape and housing approximating a same size as the magazine 10 itself. While useful, the inventor notes the prior art magazine loaders are bulky, and he notes that modification of the shape of the perimeter wall 28 in his device 100 to complement the shape of a top end of a specific model of magazine 10 can further facilitate loading of ammunition rounds without the bulk of the prior art magazine loading assist devices 30, saving material needed to manufacture the device 100 as well as valuable pocket space of the user.

The inventor stresses that his device 100 does not change the look or feel of the gun 32 and the addition of the tab 22 and perimeter wall 28 negligibly impact the weight and balance of the gun 32. The device 100 effectively eliminates the need for the user to carry the bulky prior art assist devices 30, freeing up space that would otherwise be used to store the prior art assist device with an additional loaded magazine while still allowing the user to quickly and conveniently manually reload magazines as needed.

FIGS. 14-21 show a second embodiment of the device 100 configured as an attachment to the prior art rail 50 of the gun 32. The rail 50 in this disclosure includes both prior art weaver and Picatinny rails commonly used in the gun industry, as well as other types of custom or nonstandard rails used to attach gun accessories thereto and thus the rail shown in the Figures is illustrative only and not meant to be limiting the rail 50 to the specific rail shown in terms of location, size and other characteristics. The outer facing side 20*c* of the second embodiment has a same tab 22 and gap 24 as the first embodiment of the device 100. The inner facing side 20*a* features a rail mount 52 that couples with a slot of the rail 50, and along a side of the device 100, an adjustment knob 54 couples or decouples the second embodiment of the device 100 to the rail 50. The second embodiment of the device 100 is shown mounted to the gun 32 in a location that does not interfere with the normal operation of the gun 32, and the device 100 may be further configured so as to be detachable from the rail mount 52 and serve as a replacement base plate 20 that can be later mounted to the magazine 10, or mounted with or without the rail mount 52 onto another structure to serve as the magazine loading assist device. The inventor notes that a certain amount of dexterity and hand strength is required to use his device 100, and the second embodiment of the device 100 provides a way for the user to ergonomically adapt the device 100 to suit specific needs. For the embodiment positioned on the rail 50, the device 100 can be removed from the rail 50 prior to use or used while still positioned on the rail 50. The inventor notes that in the latter scenario, it is most prudent for the user to ensure that the gun 32 is not loaded and to use all proper safety precautions if the device 100 is used mounted to the gun 32. While many guns 32 are sold with a prior art magazine loading assist device, such as those in FIG. 7, many used handguns 32 are sold without the model specific assist device and thus those owners in particular need other options. The inventor's universal device 100 thus is practical and desirable.

The device 100 is easily made using a same plastic, metal and other durable materials as current magazine base plates and gun accessories so as to not alter the balance of the gun 32 and thus the user's experience firing it.

It is to be understood that the above-described arrangements are only illustrative of the application of the principles of the present invention. Numerous modifications and alternative arrangements may be devised by those skilled in the art without departing from the scope of the present invention. For instance, in the Figures, the tab 22 is shown with a curved end contacting the round 40 to discourage the tab from slipping off the loaded round in the magazine during loading. However, the tab 22 could feature a flat contacting end with one of a compressible material, such as foam, or a slightly adhesive or tacky material, such as a thin coating of polyurethane gel, in lieu of the curved contact end to facilitate round loading by preventing lateral slip of the tab 22 as it presses down the loaded rounds 40 in the magazine. The inventor notes that the curved tab has a gentle curve for a universal fit, to allow use with a variety of ammunition round caliber sizes, however one or more pressure fitted adaptors sized for specific calibers could also be fitted over the tab to further facilitate loading of these specific calibers into the magazine 10 and thus fit more securely to the round by cupping the round.

The inventor also notes that the embodiment stored on the rail 50 could be further adapted to include or attach to an additional piece, such as a ring sized and shaped to fit over a middle finger of the user, where the additional piece is either positioned on the device inner facing side and to the rail mount 52, or alternatively the additional piece mates with the rail mount, to allow the device 100 to be removed from the rail 50 and comfortably used. The inventor notes that the rail mount 52 offers the user some additional flexibility to mount the device 100 to ergonomic pieces specifically suitable to the user when hand strength or dexterity is lacking and thus the second embodiment includes other hand held pieces of various shapes and sizes to which the rail mount 52 of the device 100 can removably mate or that are integral with the rail mount or device but not specifically described in the Figures, and yet still allow use as a magazine loading assist device as described in this disclosure. The inventor notes that having the device 100 attached to the gun itself or to components of the gun, such as the magazine or the rail, ensure that the device 100 is always conveniently positioned for the user. A key concern about gun use is ensuring all needed parts and pieces are together and incorporating the ammunition loading assist device 100 directly into the base plate 20 of the magazine 10, attaching it directly to the gun itself via the rail 50, or combinations thereof optimizes gun use by eliminating parts that can be lost or misplaced during a critical time.

I claim:

1. A magazine loading assist device for a detachable magazine for a gun, the detachable magazine having a notched uppermost end, the magazine loading assist device comprising:

a body having an inner facing side and an outer facing side;

wherein the body is a base plate of the detachable magazine;

an outer wall positioned on the outer facing side, the outer wall having a first side, a second side, a third side and a fourth side defining a perimeter of the outer wall;

a perimeter wall formed along three of the first side, second side, third side, and fourth side of the outer wall;

a tab extending away from the perimeter wall, the tab having a wall end attached to the perimeter wall and an opposed end; and a gap formed between the tab and the outer wall, the gap sized and shaped to receive the notched uppermost end of the detachable magazine.

2. The magazine loading assist device in claim 1, wherein the body is a finger extension base plate for the detachable magazine.

3. The magazine loading assist device in claim 1, wherein the perimeter wall is tapered along two of the three sides.

4. The magazine loading assist device in claim 1, wherein the gun having the detachable magazine is further comprised of a rail, and wherein the inner facing side is mounted to at least one of the detachable magazine and/or the rail.

5. The magazine loading assist device in claim 4, wherein the inner facing side of the body is at least one of permanently or removably attached to a rail mount sized and shaped to removably receive the rail or to another attachment piece.

6. The magazine loading assist device in claim 5, wherein the rail mount is adjustably sized to the rail by an adjustment knob.

7. The magazine loading assist device in claim 1, wherein the opposed end is further comprised of an approximately curved shape complementing an external shape of an ammunition round, whereby the opposed end mates with the external shape of the ammunition round when positioned immediately adjacent one another.

8. The magazine loading assist device in claim 1 wherein the opposed end is further comprised of at least one of a compressible or adhesive material.

9. The magazine loading assist device in claim 1, further comprising:

an adaptor piece matable to the opposed end of the tab having an ammunition round contacting surface sized and shaped to receive a specific ammunition round caliber size.

* * * * *